United States Patent [19]

Schaich

[11] Patent Number: 4,589,257

[45] Date of Patent: May 20, 1986

[54] METHOD AND APPARATUS FOR EXTRACTING HEAT AND MECHANICAL ENERGY FROM A PRESSURED GAS

[75] Inventor: Wilbur A. Schaich, San Antonio, Tex.

[73] Assignee: Centrifugal Piston Expander, Inc., San Antonio, Tex.

[21] Appl. No.: 678,439

[22] Filed: Dec. 5, 1984

[51] Int. Cl.[4] ..... F01K 13/00

[52] U.S. Cl. ..... 60/670; 60/645; 62/238.1; 91/197; 92/66

[58] Field of Search ..... 60/645, 651, 670, 671; 62/238.1, 238.4; 91/197, 216 R, 216 A, 216 B; 92/66, 68, 146

[56] References Cited

U.S. PATENT DOCUMENTS

| | | | |
|---|---|---|---|
| 668,822 | 2/1901 | MacLaury | 91/212 |
| 1,764,324 | 6/1930 | Livingston | 91/197 |
| 1,813,763 | 7/1931 | Price | 91/197 |
| 1,917,180 | 7/1933 | Zwick | 123/18 A |
| 2,886,017 | 5/1959 | Dib | 123/43 R |
| 2,982,261 | 5/1961 | McClintock | 91/197 |
| 3,974,801 | 8/1976 | Brown | 123/18 R |
| 4,006,595 | 2/1977 | Forbes | 60/651 |
| 4,009,576 | 3/1977 | Doerner et al. | 60/670 X |
| 4,058,088 | 11/1977 | Brown | 123/18 R |

*Primary Examiner*—Stephen F. Husar
*Attorney, Agent, or Firm*—Norvell & Associates

[57] ABSTRACT

A method and apparatus for extracting heat and mechanical energy from a pressured gas utilizes a plurality of peripherally spaced cylinders fixedly mounted in generally tangential relationship about a rotatable power output shaft. A unidirectional clutch is mounted on the shaft and the pistons provided for each cylinder are respectively provided with pivoted connecting rod connections to the outer housing of the unidirectional clutch so that movement of the pistons from the outer ends of the cylinders toward the inner ends will effect rotation of the output shaft, while reverse movement of the pistons in the cylinders will have no effect on the rotation of the output shaft. The cylinders are preferably mounted in a cylindrical wall of a hollow housing defining a sealed internal fluid pressure chamber communicating with the inner ends of each of the cylinders. A regulated gas pressure is maintained in the inner fluid pressure chamber to effect the return of the pistons to their outermost positions in the cylinders where the pistons operate inlet valves permitting a new charge of pressured gas to be supplied to the cylinders. Modifications of the invention permit sequential operation of groups of pistons and selection of the number of groups of cylinders that are in operation, thus providing a variable displacement engine. The cooled expanded gases discharged from the cylinders may be employed in either a closed or an open cycle air conditioning system. The exterior surfaces of the cylinders may be utilized to cool a stream of air passing in contact therewith.

35 Claims, 7 Drawing Figures

METHOD AND APPARATUS FOR EXTRACTING HEAT AND MECHANICAL ENERGY FROM A PRESSURED GAS

RELATIONSHIP TO OTHER CO-PENDING APPLICATIONS

This Application contains in part the disclosure of co-pending application Ser. No. 617,288, filed June 4, 1984, and Ser. No. 634,846, filed July 26, 1984, now U.S. Pat. No. 4,558,666, both of which are assigned to the Assignee of the instant invention.

BACKGROUND OF THE INVENTION

1. Field of the Invention

The invention relates to a method and apparatus for extracting heat and mechanical energy from a pressured gas by expanding same in a plurality of peripherally spaced cylinders fixedly mounted about the axis of an output shaft which is driven by a unidirectional clutch connected to pistons respectively cooperating with the cylinders.

2. Description of the Prior Art

The great majority of rotary engines designed for operation by a pressured gas have utilized linearly reciprocating pistons and cylinders. Similarly, many expanders have resorted to the use of linearly reciprocating pistons and cylinders. In most instances known to Applicant, the pistons have been connected to a crank shaft and in this manner, the reciprocating movements of all the pistons produced by expansion of a pressured gas in the cylinders is converted into a rotational power output, while the gas is concurrently cooled.

The utilization of a crank shaft inherently involves expensive precision manufacturing operations in order to ensure the balance of the crank shaft. Additionally, the successive power strokes of each piston are delayed by an interval determined by the rotational speed of the crank shaft, since this determines the time required for the piston to return from its bottom dead center position to its top dead center position in its respective cylinder. For this reason, the utilization of fluid pressure engines is primarily confined to low torque, high speed applications. It inherently does not have the ability to generate a substantial torque at low speeds due to the substantial delay in the successive expansions of the pressured gas charges supplied to each cylinder. Additionally, there is the well known deficiency involved in every crank shaft of the effective moment arm of the piston force varying cyclically from zero to a maximum and then back to zero as the piston proceeds through its entire power stroke.

SUMMARY OF THE INVENTION

The invention provides a plurality of peripherally spaced cylinders mounted in generally tangential relationship to the periphery of a fixed cylindrical housing defining an enclosed cylindrical fluid pressure chamber. The housing surrounds an output shaft which is rotatably supported by suitable bearings in the housing and fixed pillars. Each of the tangentially disposed cylinders cooperates with a piston. Each piston, in turn, is connected by a connecting rod to the housing or casing element of a unidirectional or one way clutch. Such clutch is mounted within the fluid pressure chamber and its inner rotor is rotatably secured to the output shaft. The unidirectional clutch may comprise any one of several well known forms currently available on the market, and it is constructed so that the movement of the pistons away from the closed outer ends of the cylinders produces a rotation of the output shaft by the clutch, while the reverse movement of the pistons has no effect on the rotation of the output shaft. The interconnection of the pistons to a common housing element of the unidirectional clutch assures that all of the pistons will move in synchronism and hence eliminates the necessity for elaborate electronic control circuitry to insure the synchronous movement of the pistons.

The inner ends of each of the cylinders are in open communication with the fluid pressure chamber. The gas pressure within such chamber is regulated to normally maintain at all times a pressure value that is in excess of atmospheric or ambient pressure. A charge of pressured gas is introduced into the outer end of each cylinder when the pistons reach their outermost position. Such pressured gas causes the pistons to move away from the outer ends of the cylinders, thus imparting a driving force through the unidirectional clutch to the rotatable output shaft. After a desired amount of expansion of the gas has been accomplished, a radial port in each of the cylinders is uncovered by the linear movement of the respective piston, thus assuring that the outer face of the piston is exposed only to atmospheric or ambient pressure during most of its return stroke.

Thus, the regulated internal pressure of the cylindrical fluid pressure chamber acts on the inner face of each piston to stop its inward movement and relatively move the pistons back through the cylinder to the outer closed end of the respective cylinder. The movement in this direction is freely permitted by the unidirectional clutch and can be accomplished at a much higher speed than the power stroke of the piston which is limited by the rotational speed of the output shaft and the load which it is driving. Moreover, the piston elements can be of light construction so that very little mass is involved in the entire piston and unidirectional clutch assemblage. Thus, in typical low speed, high torque applications, the pistons return from their remote positions relative to the closed cylinder ends at a speed that may be substantially greater than the speed of the power stroke of the pistons. It follows that a substantially greater number of power strokes of the pistons is accomplished during any given time interval, and hence substantially greater torque per minute is applied to the rotatable output shaft. Moreover, the effective moment arm of such torque is substantially constant since the connection of each piston to the rotatable outer housing of the unidirectional clutch is at a substantially constant torque arm with respect to the axis of rotation of the rotatable output shaft.

The invention further contemplates that the expanded cooled gas which is discharged from the cylinder ports as the pistons near the end of their power stroke may be utilized for cooling or air conditioning purposes. Thus, if the gas employed is air, the cooled air may be introduced directly into a room or chamber requiring cooling. A description of the invention used in a Brayton cycle air cooling system would be as follows: Air would be withdrawn from the room to be cooled and passed through a compressor to a sink where heat is rejected and then the air would pass through the expander invention described herein, producing mechanical energy and the cooled air derived therefrom would then be blown into the room, thus cooling same. The expander invention herein described could be used to additionally provide mechanical energy to assist in driving the compressor in the aforementioned Brayton cycle air cooling system, and thus reduce the electrical energy requirements for the compressor from other sources.

The invention further contemplates that a closed/-Rankine cycle operation for the expander invention herein described may be utilized to produce power to assist in driving the compressor of a conventional Rankine cycle air conditioner currently available in the marketplace and would operate in the following manner: A boiler deriving its heat from any source, including solar, would heat any of the refrigerant type gases, such as Freon which would then, as a gas, pass through the expander invention herein described, producing mechanical energy, and thereafter the cooled gas would pass through a condenser-sink where the gas is condensed into a liquid and, as a liquid, then passes through a pump to be returned to the boiler to be reheated. The expander invention herein described could be used in the Rankine cycle operation heretofore described to produce the mechanical energy to assist in driving the compressor found in a conventional Rankine cycle air conditioner and thus reduce the energy requirements for the compressor from other sources and, further, the expander invention herein described could use the mechanical energy it produces to assist in driving the pump in the aforementioned Rankine cycle operation.

The apparatus of this invention has the further advantage of permitting selective operation of selected groups of cylinders in order to provide a variable displacement engine. The engine is constructed with two or more axially spaced sets of cylinders, together with two or more unidirectional clutches respectively cooperating with the pistons of each set of cylinders. The variable displacement operation becomes unusually efficient because the one set of cylinders may be cut off from the fluid pressure source, thus permitting energization of only the other set of cylinders. The pistons in the de-energized set of cylinders will not, however, continue to reciprocate since they are isolated from rotational movement of the output shaft by the unidirectional clutch, hence minimizing friction and compression losses of energy.

Still another form of variable displacement operation may be obtained by cutting off the gas pressure supplied to the internal chamber of one or more of the sets of cylinders, thus preventing the return of the pistons to the closed end of the cylinders. Since the inlet valves preferably employed are actuated by the return movement of the pistons to the outer ends of the cylinders, it is obvious that no pressured gas is applied to the set of cylinders for which the return fluid pressure has been cut off.

In a similar manner, sequential firing of pistons may be obtained by arranging the cylinders in axially spaced sets along the output shaft and providing a separate unidirectional clutch for each set of pistons and cylinders to smooth out the operation of the apparatus. The return fluid pressure may then be supplied to the internal chambers of each of the sets of cylinders and pistons in timed sequence, and thus the pistons of any one set will be energized in timed relationship to the energization of the pistons of the other sets.

Lastly, the invention contemplates that the cylinders themselves may be utilized as the cooling elements in an air cooling system, due to the extraction of substantial amounts of heat from such cylinders by contact with the expanding gas. In such instance, one or more sets of cylinders and pistons may be mounted on a common rotatable output shaft and enclosed within a housing. An airstream is produced through such housing in contact with the cooled cylinders, thus cooling the air and warming the cylinders. Preferably, the airstream is produced by a fan mounted on the output shaft of the apparatus.

Further objects and advantages of the invention will be readily apparent to those skilled in the art from the following detailed description, taken in conjunction with the annexed sheets of drawings, on which are shown several embodiments of the invention.

DESCRIPTION OF PREFERRED EMBODIMENTS

Figure 1:
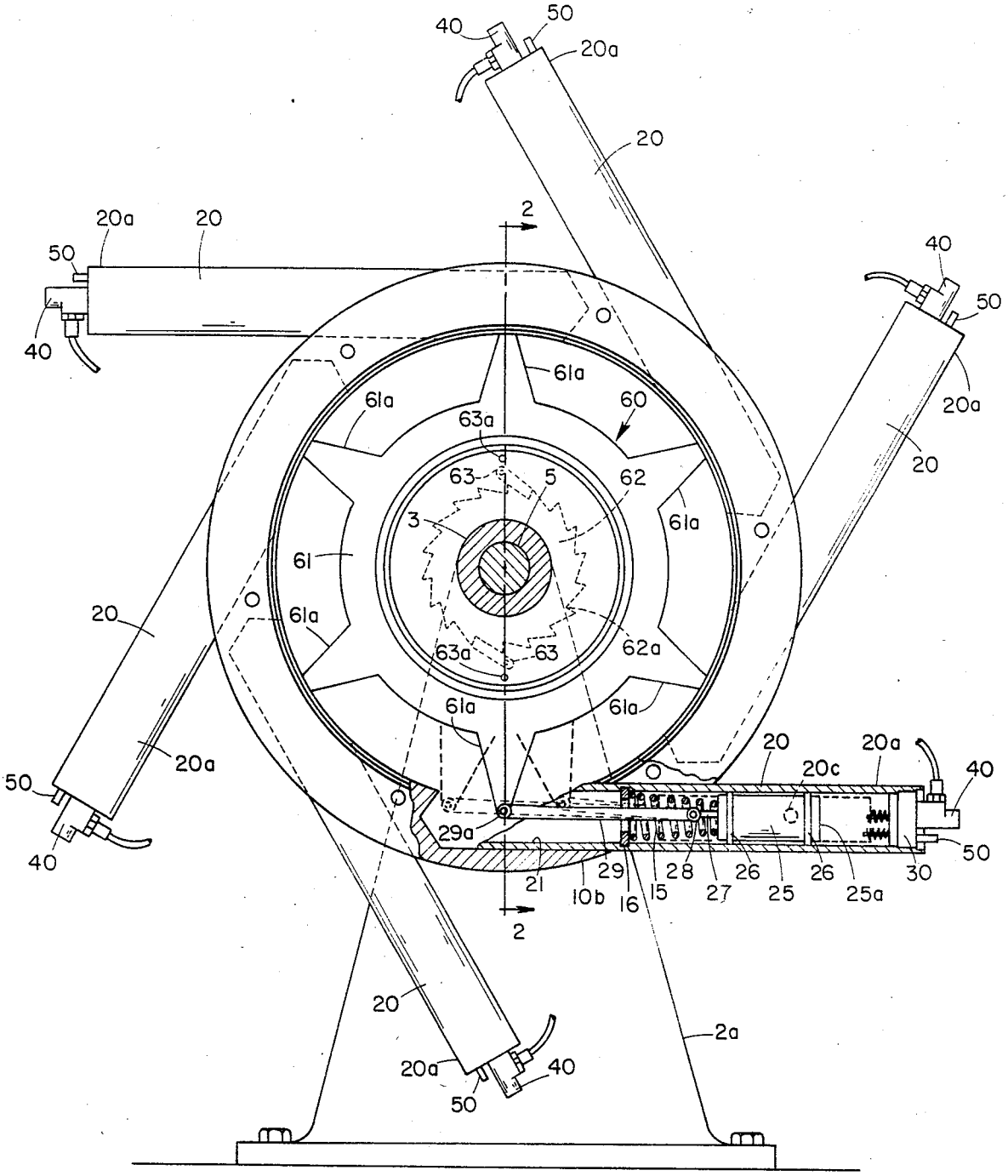
FIG. 1 is a schematic elevational view, partly in section and with the cover plate remover, of a fluid pressure operated rotary engine or expander embodying this invention.
Figure 2:
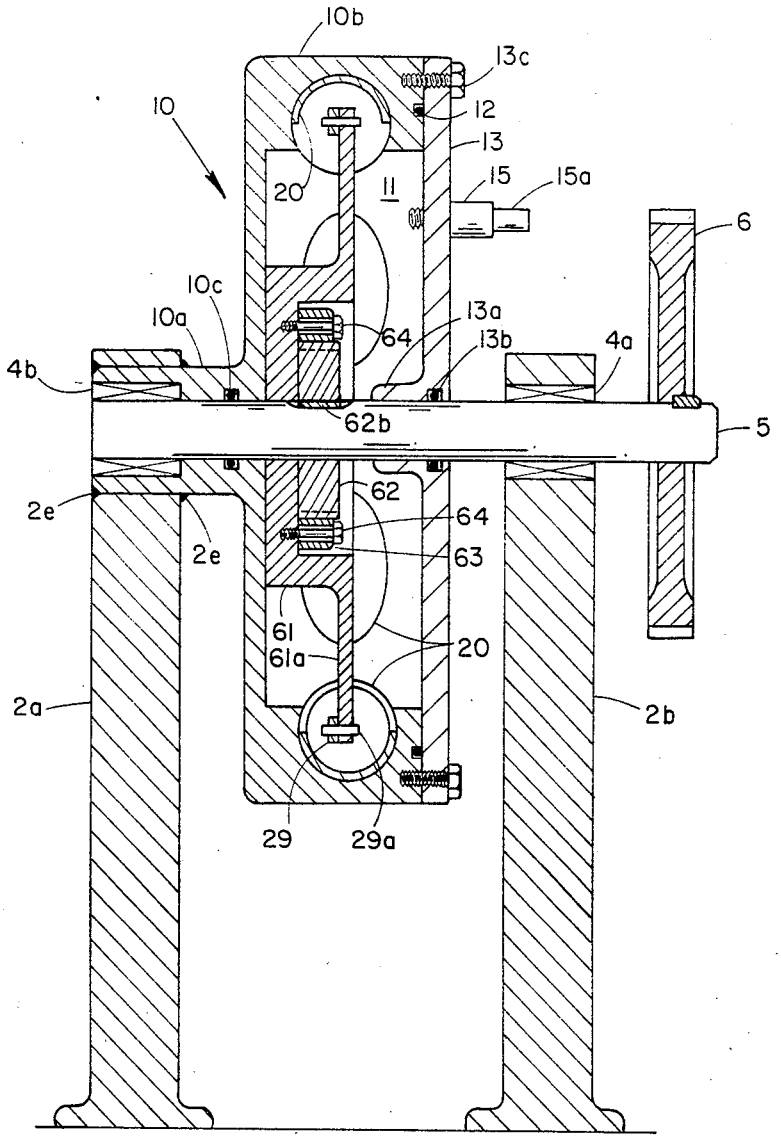
FIG. 2 is a vertical, sectional view of the engine taken on the plane 2—2 of FIG. 1.

Referring particularly to FIGS. 1 and 2, an apparatus 1 embodying this invention comprises a pair of laterally spaced bearing pillars 2*a* and 2*b*. A rotatable output shaft 5 is supported at one end in an antifriction bearing 4*a* mounted in the pillar 2*b*. Output shaft 5 may drive a gear or pulley 6. The other end of the output shaft 5 is rotatably journalled in a bearing 4*b* which is mounted within the hollow hub 10*a* of a generally cup-shaped cylindrical housing 10. Housing hub 10*a* is fixedly secured to pillar 2*a* by welds 2*e*. Housing 10 defines a generally cylindrical fluid pressure chamber 11 concentrically surrounding the axis of the rotatable output shaft 5. Fluid pressure chamber 11 is closed by a circular cover plate 13 having a central hub 13*a* rotatably mounted relative to the output shaft 5 and sealed thereto by an O-ring 13*b*. Cover plate 13 is secured to the rim of the annular wall portion 10*b* of the cup-shaped housing 10 by a plurality of peripherally spaced bolts 13*c* and sealing is effected by a gasket 12. Additionally, an O-ring 10*c* is provided in the interior of the hub portion 10*a* to complete the sealing of the fluid pressure chamber 11.

A conventional pressure regulator 15 is suitably connected to the housing 10 so as to be in communication with the cylindrical pressure chamber 11, and regulator 15 is connected by a pipe 15*a* to a suitable source of pressured gas. Regulator 15 also has a connection (not shown) to atmospheric or ambient pressure surrounding the apparatus 1 and may be adjusted in conventional fashion to maintain a predetermined gas pressure within the cylindrical fluid pressure chamber 11 which at all times is in excess of atmospheric or ambient pressure. The exact requirements for the pressure to be maintained in chamber 11 by the pressure regulator 15 will be developed in detail hereinafter.

As best shown in FIG. 1, a plurality of fluid pressure cylinders 20 are rigidly mounted in peripherally spaced relationship in the cylindrical wall portion 10*b* of the housing 10. Each of the cyinders 20 is disposed with its axis in generally tangential relationship to the periphery of the cylindrical fluid pressure chamber 1, hence, relative to the axis of rotation of the rotatable power output shaft 5. Cylinders 20 may be conveniently assembled to the housing 10 by drilling holes through the thickened annular wall 10*b* to snugly accommodate the cylinders 20, and then braising the cylinders in such holes. The inner end of the bore 21 of each cylinder 20 is in fluid communication with the cylindrical fluid pressure chamber 11. The outer ends of each cylinder are closed by a cylinder head assemblage 30 containing both an inlet valve 40 and an exhaust valve 50, both of which will be described hereinafter.

Within each of the cylinders 20, a piston 25 of conventional cylindrical configuration and carrying a pair of piston rings 26, is slidably mounted for reciprocating movements therein. Each of the pistons 25 has a stem portion 27 defining a pivot bore for receiving a wrist pin 28 which pivotally connects to one end of a connecting rod 29. The other end of connecting rod 29 is pivotally connected by pin 29*a* to a pivot projection 61*a* formed on the outer housing or casing 61 of a unidirectional or one way clutch 60.

Unidirectional clutch 60 is of the class referred to in the art as a sprag-type unidirectional clutch, and incorporates a central element 62 which is secured in any conventional manner, as by a key 62*b*, to the rotatable power output shaft 5. The central element 62 is concentrically surrounded by the outer housing or casing 61 which is freely rotatable with respect to the output shaft 5. Housing 61 is connected to the central clutch element 62 by a plurality of peripherally spaced sprags or detents 63 which are pivotally mounted in conventional fashion on bolts 64 and spring biased by appropriate torsion springs (not shown) into abutting engagement with teeth 62*a* formed around the perimeter of the central clutch element 62. The teeth 62*a* of the central clutch element 62 are constructed to prevent clockwise rotation of the housing 61 relative thereto, but freely permit counter clockwise relative rotation of the housing 61. Thus the outer housing 61 and the connected pistons 25 can only effect rotation of the output shaft 5 in one direction, which is clockwise as viewed in FIG. 1. This direction of rotation corresponds to the power stroke of the pistons 25 as they move from the outer closed ends of the cylinders 20 to the open ends thereof. Return movement of the pistons 25 toward the closed ends 20*a* of cylinders 20 is freely permitted by the unidirectional clutch 60 independent of the continued rotation of the power output shaft 5.'

Figure 3:
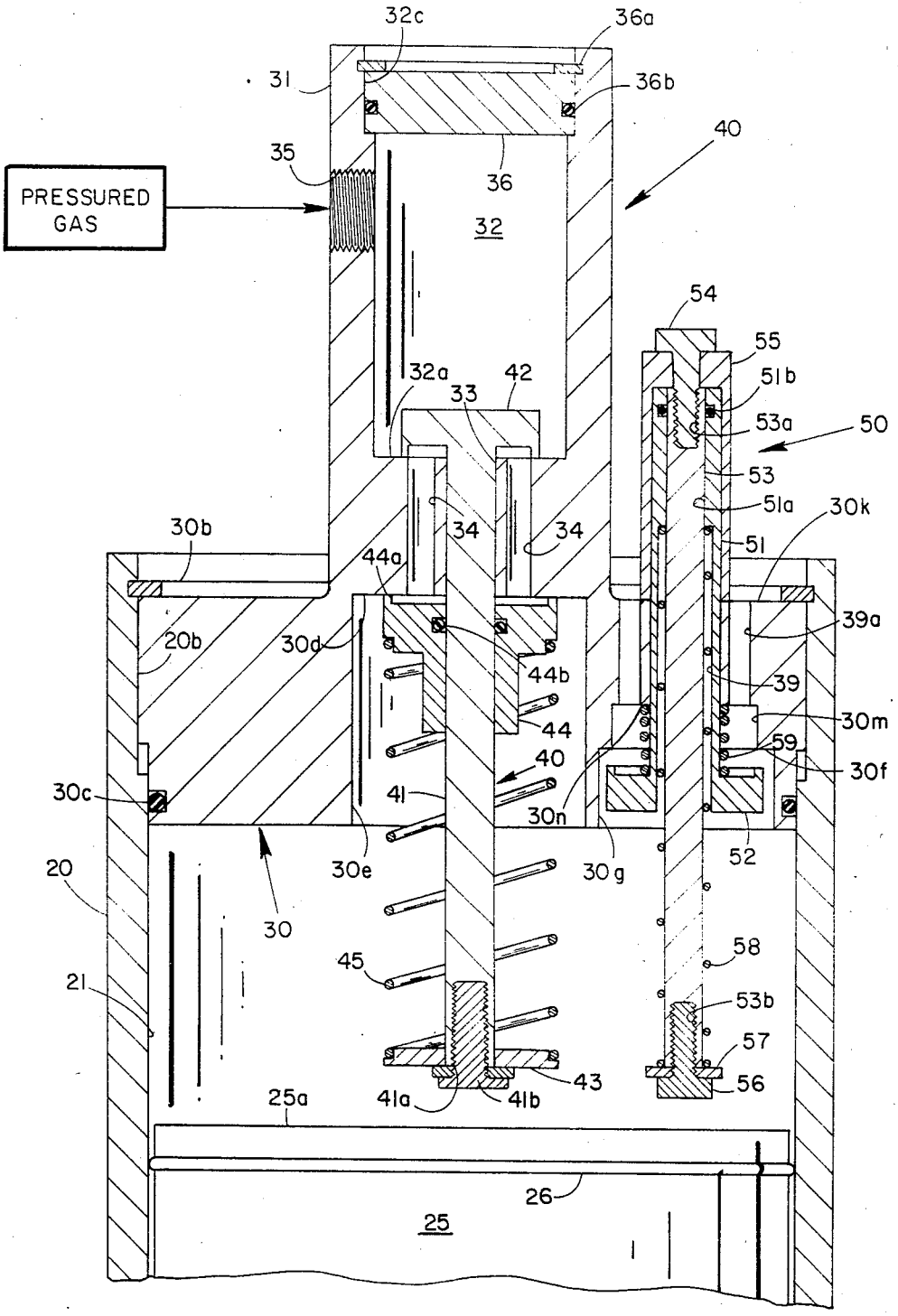
FIG. 3 is an enlarged scale sectional view of the valving mechanism employed in the ends of the cylinders in all modifications of the invention.

Referring now particularly to FIG. 3, the outer end 20*a* of each cylinder 20 is closed by a cylinder head 30 which seats in a counter bore 20*b* in the outer ends of the respective cylinder 20 and is secured in the counter bore 20*b* by a C-ring 30*b*. An O-ring seal 30*c* provides the necessary sealing of the cylinder head 30 within the respective cylinder 20. Each cylinder head 30 is provided with an axial extension 31 which in turn defines a fluid inlet pressure chamber 32 which communicates with a reduced diameter valve stem mounting bore 33, which in turn is surrounded by a plurality of peripherally spaced inlet passages 34. The inlet passages 34 communicate with the interior of the fluid pressure chamber 21 defined by the respective cylinder unit 20. The outer end of inlet fluid pressure chamber 32 is closed by a plug 36 which is secured in counter bore 32*c* by a C-ring 36*a* and sealed by an O-ring 36*b*.

The internal fluid pressure chamber 32 is provided with an internally threaded radial port 35 which receives a suitable coupling for connection to a pipe (not shown) which in turn is connected to the source of pressured gas which is to be utilized for operating the apparatus.

The inlet valve 40 further comprises a stem type valve element 40*a* having a head portion 42 which overlies all of the fluid inlet passages 34 and effects a sealing engagement with the inner end wall 32*a* of the fluid pressure inlet chamber 32. Head portion 42 has an integrally formed, solid stem portion 41 projecting into the cylinder chamber 21. The internal end of stem 41 is internally threaded as indicated at 41*a* to receive a bolt 41*b* which mounts a spring seat 43 against the end of the stem portion 41.

An inlet check valve 44 comprises an annular block which is mounted in sliding but sealable relationship on the internal end of stem 41. O-ring 44*b* provides the seal. Inlet check valve 44 is provided with an annular sealing surface 44*a* which overlaps all of the fluid inlet passages 34 and can effect a sealing engagement with the end wall 30*d* of a couner bore 30*e* provided in the inner face of the cylinder head 30. Inlet check valve 44 is urged into sealing engagement with the surface 30*d* by a spring 45 which operates between a peripheral shoulder provided on the valve block 44 and a peripheral shoulder provided on the spring seat 43. Thus, the spring 45 effects a biasing of the inlet valve block 44 into sealing engagement with the inlet ends of the fluid inlet passages 34 and, at the same time, provides a bias urging the stem valve head 42 into sealing engagement with the outer ends of the inlet fluid passages 34. The normal position of inlet valve 40 is closed, as illustrated in FIG. 3, wherein no contact of the inwardly projecting valve stem 41 has been established with the outer face 25*a* of the piston 25. Inlet valve 44 functions as a spring biased check valve between cylinder chamber 21 and inlet chamber 32 so as to prevent the reverse flow of pressured gas from the cylinder chamber 21 into the fluid pressure inlet chamber 32 when the piston 25 approaches the outermost end of its stroke.

Cylinder head 30 also defines an opening 39 passing entirely through the cylinder head which provides a mounting for the stem portion 51 of an exhaust valve 50. Additionally, a plurality of peripherally spaced exhaust passages 39*a* are provided around the stem opening 39.

The exhaust valve 50 is provided with a head portion 52 which overlaps the inner ends of all of the fluid exhaust passages 39*a* and effects a sealing engagement with a radial surface 30*f* formed in the bottom of a counter bore 30*g* which encompasses all of the exhaust fluid passages 39*a*. The stem portion 51 of the exhaust valve 50 is integrally formed with the head portion, is of tubular configuration, and extends slidably through the exhaust valve opening 39. Stem portion 51 is provided at its outer end with a reduced diameter internal bore 51*a* providing a mounting for an actuating rod 53. An O-ring 51*b* effects the required seal between the actuating rod 53 and the bore 51*a*.

The outer end portion of the actuating rod 53 is provided with a threaded bore 53*a* for receiving a bolt 54. Bolt 54 secures a positioning collar 55 to the end of the valve stem. Collar 55 has its inner end face abutting the outer face 30*k* of the cylinder head 30. The other end of the actuating rod 53 projects into the cylinder chamber 21 and is also provided with a threaded bore 53*b* and a bolt 56 is mounted in such threaded and provides a securement thereto of a spring seat 57. A spring 58 is then mounted between spring seat 57 and the internally projecting shoulder defined between the reduced diameter bore portion 51*a* of the valve stem 51 and the remainder of the hollow exhaust valve ste. Thus, so long as the actuating rod 53 is not shifted by the piston 25, the spring 58 does not maintain the exhaust valve 50 in its closed position. A relatively light spring 59 is provided which operates between the outer face of the head portion 52 of the exhaust valve 50 and the end wall 30*n* of a counterbore 30*m* in the cylinder head 30 to maintain the exhaust valve in its illustrated position in FIG. 3 wherein it is not in sealing engagement with respect to the exhaust fluid passages 39*a*.

The operating of the aforedescribed inlet and exhaust valves as a function of the movement of piston 25 will be readily understood by those skilled in the art. As the piston 25 moves outwardly in the respective cylinder chamber 21, it first engages the bolt 56 and shifts the actuating rod 53 of the exhaust valve outwardly, thus compressing the light spring 59. This forces the exhaust valve 50 to move to its closed position. The inlet valve 40 was already in its closed position and remains in its closed position until the outer face 25*a* of piston 25 contacts the head of bolt 41*b* and displaces the inlet valve 30 in an outward direction, thus opening the inlet fluid passages 34 and permitting pressured gas to be supplied to the cylinder chamber 21 from the inlet fluid pressure chamber 32. Such supply of pressured gas continues so long as the fluid pressure on the cylinder side of the cylinder head 30 is less then the fluid pressure in the inlet fluid pressure chamber 32. Whenever the gas pressure in cylinder 21 builds up to a point where it is in excess of the pressure in the fluid inlet chamber 32, the inlet check valve 44 will be shifted from its open position to the closed position shown in FIG. 3 and further supply of inlet gas will be cut off. Thus, both the inlet valve 40 and the exhaust valve 50 are in closed positions as the piston 25 nears the outer end of its stroke and the gas trapped between the outer face 25*a* of the piston 25 and the cylinder head 30 will be compressed to a sufficiently high value to insure that the piston will be brought to a cushioned stop and its motion reversed by the compressed gases.

As the piston moves relatively inwardly in the respective cylinder chamber 21, away from closed end 20*a*, the exhaust valve 50 remains in its closed position due to the excess of the internal pressure on the inner side of the valve over the ambient pressure existing on the other side of the valve. Similarly, the inlet check valve 44 will remain in its closed position, due to the pressure differential across such valve until the stem portion 41 of the inlet valve 40 has returned to its normal position under the bias of the spring 45, at which point the head 42 of the inlet valve 40 will effect the sealing of the inlet fluid passages 34.

As each piston 25 approaches the inner end of its relative inward stroke, it uncovers a radial port 20*c* (FIG. 1) provided in the wall of the respective cylinder 20 and thus permits the dumping of the remaining pressure in the cylinder 21 to atmosphere or ambient. This permits the exhaust valve 50 to be moved to its open position under the influence of the relatively light spring 59, and the valving system is then ready for another cycle of operations.

The structure and operation of the aforedescribed inlet valve 40 and outlet valve 50 forms the subject matter of U.S. application Ser. No. 617,288, filed June 4, 1984 and assigned to the Assignee of this invention, and reference should be had to such application for any further details concerning the construction and operation of the inlet and outlet valves.

From the foregoing description, it will be apparent that the operation of the inlet and exhaust valves is entirely controlled by the position of the respective piston, and the action of such valves in moving to the required open or closed position is substantially instantaneous, hence will not be adversely affected by the speed of reciprocation of the pistons 25. Of equal importance is the fact that all of the pistons 25 are moving concurrently due to their interconnection to the unidirectional clutch element 60.

As previously stated, the internal gas pressure in chamber 11 is maintained by pressure regulator 15 at a value above the ambient atmospheric pressure surrounding the engine 1. The amount that the gas pressure in internal pressure chamber 11 exceeds the atmospheric or ambient is preferably just sufficient to insure the stopping of the inward motions of the pistons 25 after exhaust valves 20*c* are opened and to reverse the motions of such pistons to return them to the outer ends 20*a* of the cylinders 20 and to compress the valve springs 58 and 45 disposed at such outer ends. As an adjunct to the return force provided by the gas pressure in chamber 11, a stop spring 15 may be provided which is seated upon a snap ring 16 located in the inner extremity of the piston of each cylinder 20. Thus, the stop spring will be engaged by the piston 25 after it has passed the respective exhaust port 20*c* and assists in stopping the inward motion of such piston and returning the piston to its outer position adjacent the closed end of the cylinder 20. Of course, the spring 16 could be proportioned to provide the entire returning force on the piston 25, but this is not preferred since that spring force is not conveniently adjustable as is the gas pressure within the fluid pressure chamber 11.

When the described apparatus is to be utilized as an engine to drive a heavy load at low speed, it may be desirable to increase the fluid pressure in the fluid pressure chamber 11 somewhat so as to speed up the return of the pistons 25 to their outermost positions in the cylinders 20 adjacent the closed ends 20*a*. This obviously reduces the time between successive power strokes of the piston and adds substantially to the average torque, and hence the horsepower output produced by the apparatus 1. The pistons 25 and the housing 61 of the unidirectional clutch 60 are preferably fabricated from light metal materials consistent with the strength requirements, so that the inertia mass associated with the pistons 25 will be maintained at a minimum, permitting the pistons 25 to be rapidly returned from their innermost positions to their outermost positions to increase both the torque and the horsepower output of the apparatus.

When the described apparatus 1 is to be utilized as an expander in a Brayton cycle air cooling system, air is withdrawn from the room to be cooled, pressurized by a suitable compressor and the pressured air would be utilized to drive the apparatus 1 and any connected load and would produce cooled air which would be directed into the room of chamber to be cooled.

Lubrication of the described device may be accomplished in a variety of manners, including the introduction of lubricating fluid as a mist suspended in the pressured gas. Because of the fact that the cylindrical fluid pressure chamber 11 is completely sealed, the lubrication can be effectively accomplished by introducing a small quantity of lubricating fluid directly into such chamber and such fluid will be distributed over all of the working surfaces of the pistons, cylinders and the unidirectional clutch assembly due to the reciprocating movement of the connecting rods and the clutch housing. The combination of such movements insure that lubricant fluid will be splashed onto all of the surfaces requiring lubrication, except, of course, the anti-friction bearing elements 4*a*, 4*b* and 4*c* which are presealed with a lubricant.

If the available pressured gas is air at modest pressures (50–150 psi) then the exhaust valves 50 and exhaust ports 20*c* can vent directly to atmosphere. On the other hand, if the pressure source is gas from a well, and particularly high pressure gas, it would be undesirable to exhaust into the atmosphere. In such case, the engine 1 may be enclosed to recover the exhaust gas at a suitable ambient level, well above atmospheric pressure, thus permitting further energy extraction from the pressured exhaust gas.

Figure 4:
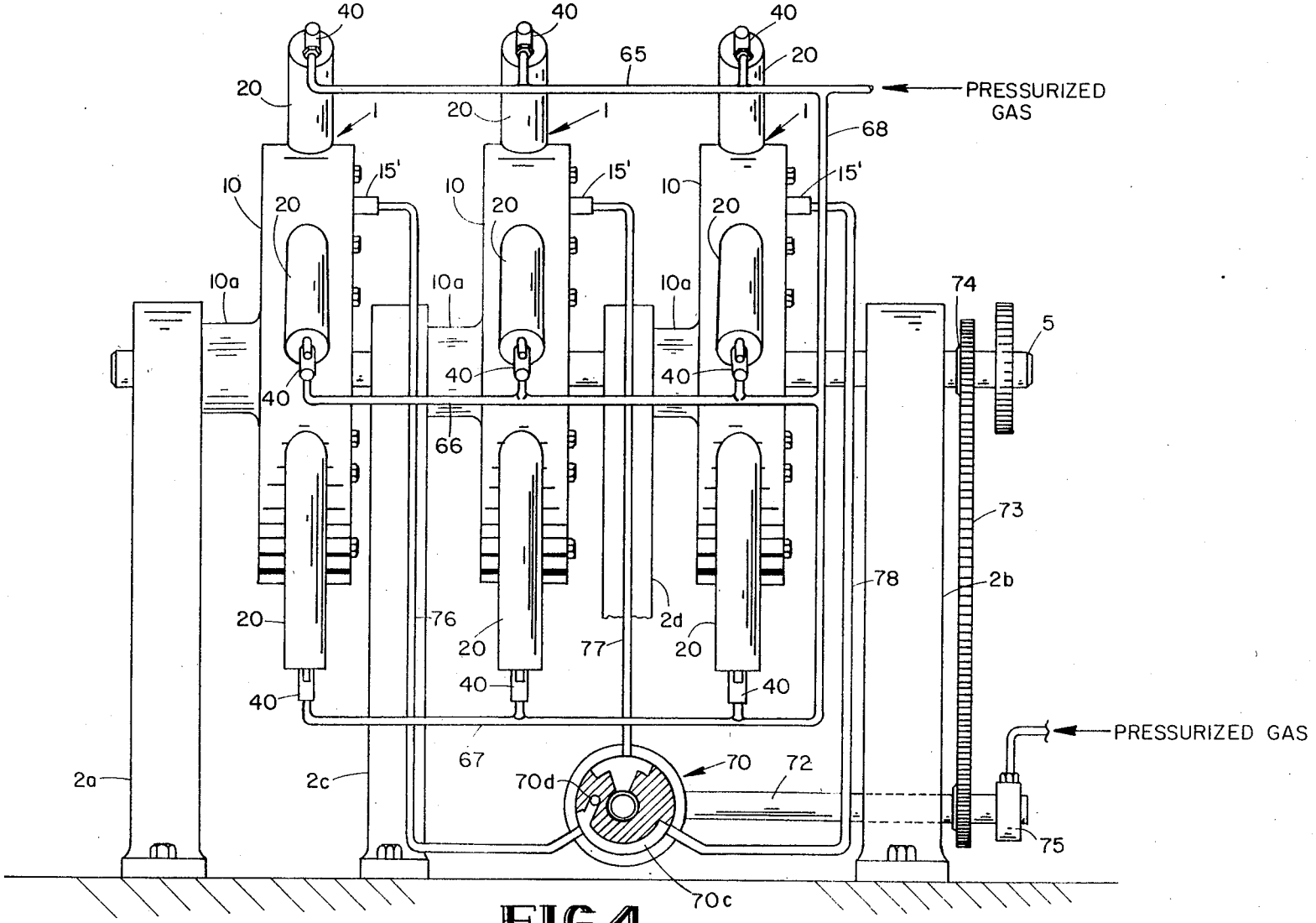
FIG. 4 is a side elevational, schematic view illustrating the sequential operation of the cylinders of an engine having axially spaced sets of cylinders.

Referring now to FIG. 4, where similar numbers refer to apparatus previously described, there is disclosed an apparatus embodying this invention wherein sequential energization of a plurality of pistons may be accomplished to further increase the torque and horsepower output of the apparatus. In this modification, a plurality of sets of apparatuses 1, including housings 10, cylinders 20 and pistons 25 and unidirectional clutches 60, are provided in axially staked relationship along the rotatable power output shaft 5 and supported by bearing pillars 2*a*, 2*b*, 2*c* and 2*d*. The pressured gas from which heat and mechanical energy is to be derived is supplied from a single source to the cylinders 20 by pipe manifolds 65, 66 and 67 which are in turn interconnected by a cross pipe 68.

The pressure regulators 15 are replaced by nipples 15'. The internal fluid pressure within each of the fluid pressure chambers 11 within the housings 10 is sequentially applied to each of the housings by a rotating control valve 70 which is mounted on a hollow shaft 72 driven by a chain 73 from a sprocket 74 on power output shaft 5. Rotatable control valve 70, which is shown in a 90°-turned position in FIG. 4 for clarity, comprises a valving disc 70*a* in which is provided a recess 70*b* communicating with the bore of the hollow shaft 72. Pressured fluid is supplied through the hollow shaft 72 from a suitable source through a conventional fluid coupling 75. As the valve disc 70*a* rotates the pressured gas is supplied in turn to each of the internal chambers 11 of the three axially stacked apparatuses by conduits 76, 77 and 78 which are secured to peripherally spaced ports provided in the rotary valve 70.

Thus, only one of the conduits is supplied with fluid pressure at any one time. While that conduit is receiving fluid pressure, the other two conduits are in communication with a second peripheral recess 70*c* provided on the valving disc 70*a* and this recess is connected to atmosphere by a suitable axial conduit 70*d*. Thus, while one of the apparatuses 1 is supplied with fluid pressure to return the piston of such one apparatus to their outer positions in the cylinders 20, the other two internal pressure chambers 11 of the other two apparatuses 1 are at atmospheric pressure, and no force is exerted on the pistons 25 to return them to the outer closed end 20*a* of the cylinders 20. Thus, sequential operation of the three apparatuses is obtained and the driving torque is supplied at three distinct intervals rather than concurrently as would be the case if the internal fluid pressure chambers were concurrently energized from a source of pressured gas.

Figure 5:
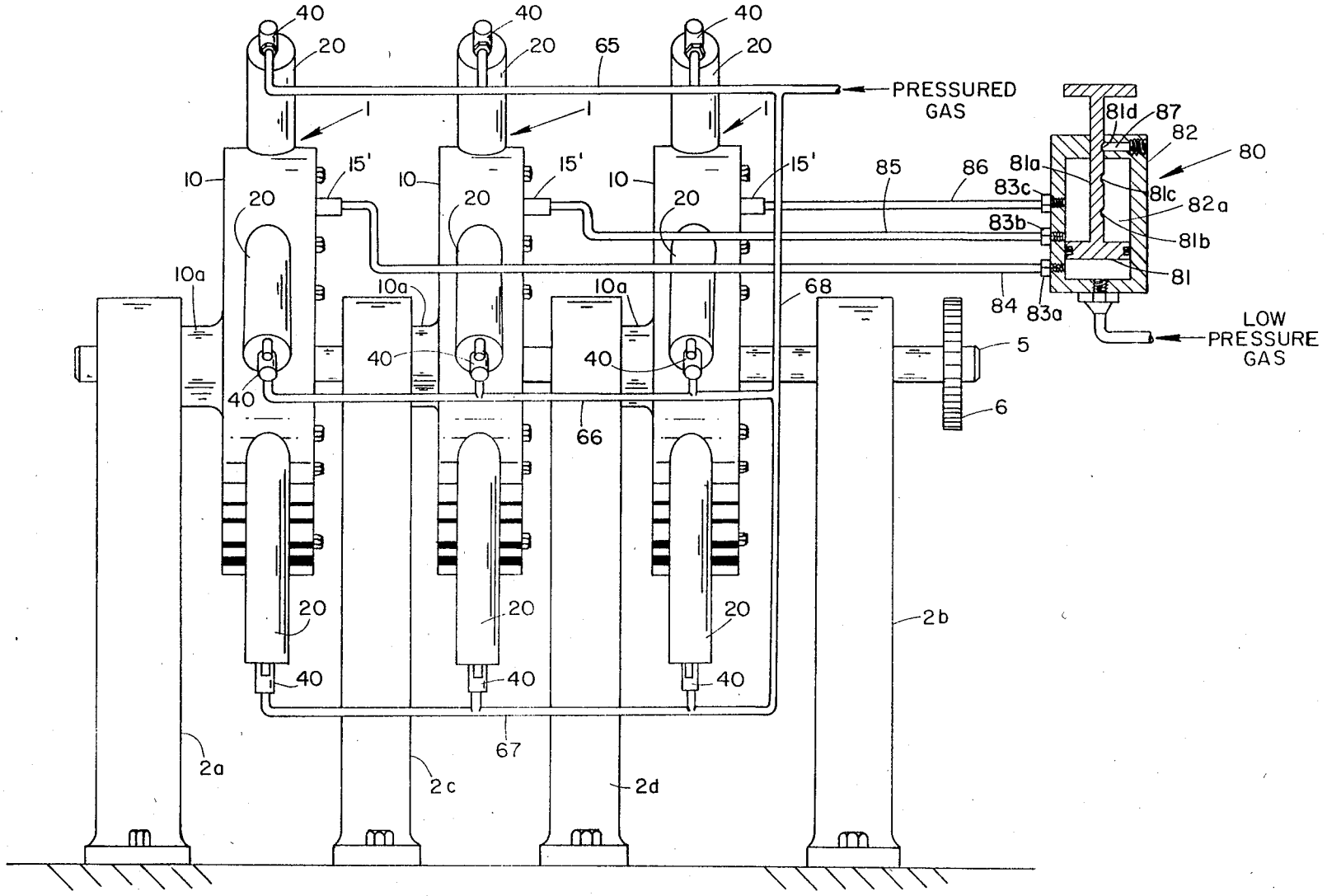
FIG. 5 is a side elevational view of an engine embodying this invention utilizing three axially spaced sets of cylinders wherein variable displacement operation of the engine is accomplished by controlling the piston return fluid pressure.

Referring now to FIG. 5, there is disclosed a control arrangement for an axially stacked set of apparatuses 1 which is substantially identical to the previously described arrangement of FIG. 4. Pressured gas is again supplied to the outer ends of the cylinders 20 by pipe manifolds 65, 66 and 67 which are interconnected by pipe 68. In this modification, however, the low fluid pressure gas required to return the pistons to the outer ends of the cylinders 20 is supplied through a selection valve 80. While valve 80 is schematically illustrated to be manually operable, those skilled in the art will understand that it could be pneumatically or electrically controlled in response to load conditions.

The valve 80 includes a valving plunger 81 which is reciprocable within an enclosed chamber 82*a* defined by a housing 82. Valve plunger 81 is manually shiftable to any one of three positions relative to outlet ports 83*a*, 83*b* and 83*c* which respectively communicate with the inlet nipples 15' provided on each of the respective apparatuses 1. The stem portion 81*a* of the valve plunger is provided with three axially spaced notches 81*b*, 81*c* and 81*d* which are respectively engaged by a spring pressed detent 87 to secure the plunger in each of the selected positions. Thus, when the valve plunger 81 is in its illustrated lowermost position, low pressure gas is supplied by conduit 84 to only one of the apparatuses 1; when in its intermediate position, low pressure gas is concurrently supplied to two of the apparatuses 1 by conduits 84 and 85, and when positioned in its uppermost position, low pressure gas is supplied concurrently to all three of the apparatuses 1 by conduits 84, 85 and 86. Thus, a variable displacement engine is provided wherein the effective cylinder displacement may be selectively varied between three values merely by shifting the valve plunger 81 in the enclosed chamber 82.

Figure 6:
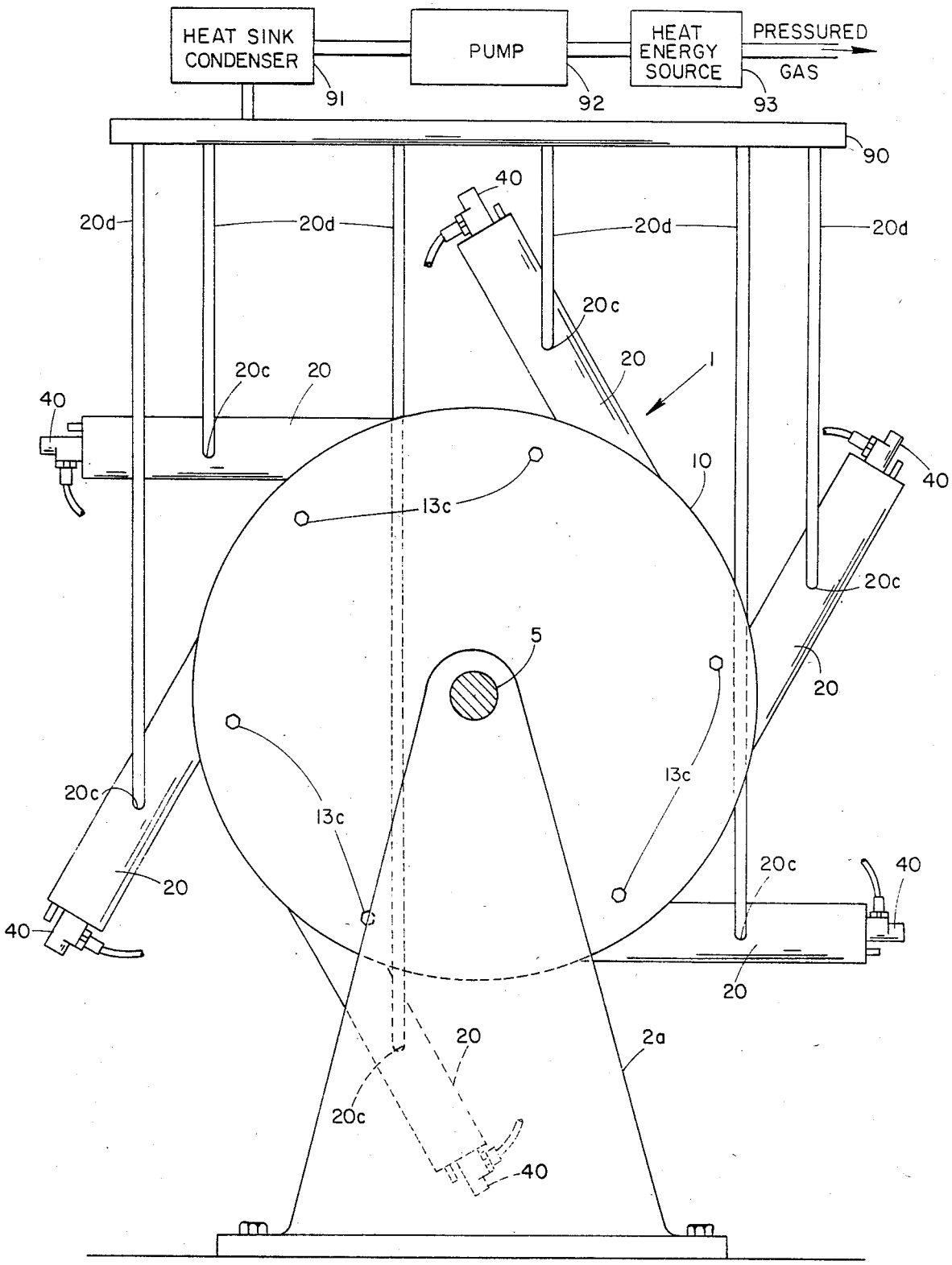
FIG. 6 is a schematic side elevational view illustrating the operation of the apparatus of this invention as an expander for effecting the expansion and cooling of a gas in a closed cycle system including a heat energy source.

Referring now to FIG. 6, there is schematically illustrated an arrangement for utilizing the apparatus 1 for the cooling of the pressured gas such as Freon, during its expansion in the cylinders 20 to perform a cooling function in a closed Rankine cycle system employing a heat source. Thus, each of the exhaust ports 20*c* of the cylinders 20 is connected by conduits 20*d* to a manifold 90 which in turn is connected to a heat sink-condenser 91 which converts it to a liquid. From the heat sink-condenser 91, the liquid flows into a pump 92. Pump 92 may conveniently be driven by the rotatable output shaft 5, if desired. From the pump 92, the fluid passes into any heat energy source 93 such as a solar unit which restores the fluid to its original gas pressure and temperature, and thus the pressured gas is resupplied to the inlet valves 40 provided on the ends of the cylinders 20.

This arrangement has particular utility in areas of the country having a large amount of sunshine or geothermal energy and a limited amount of electrical power available. The solar energy source could be employed in conjunction with the apparatus 1 in a closed Rankine cycle as illustrated in FIG. 6, to drive a compressor and fan for a conventional air conditioning system. Concurrently, the rotatable output shaft could be utilized to drive a pump in the Rankine cycle, or an electrical generator, or any other type of rotatable load.

Figure 7:
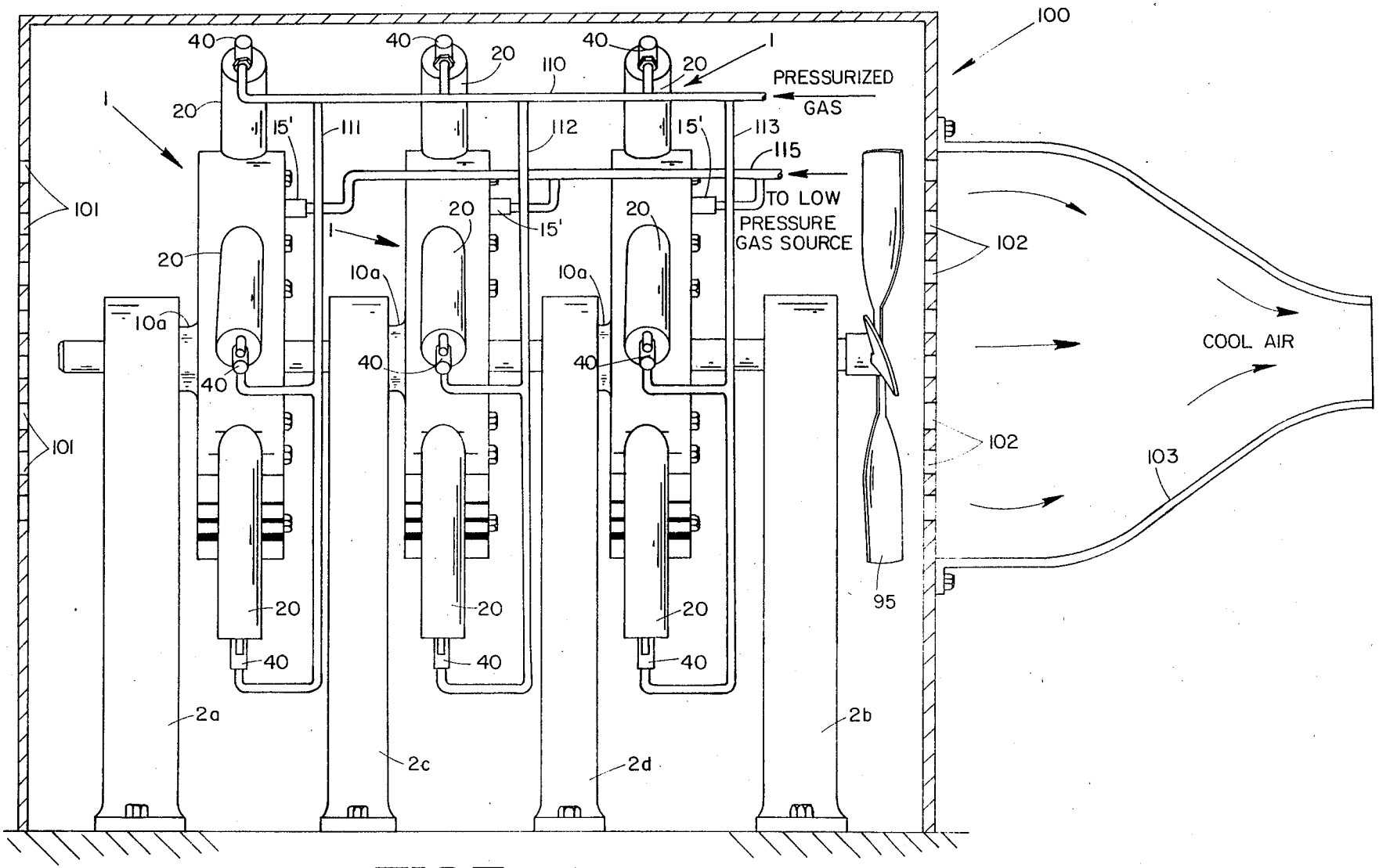
FIG. 7 is a schematic elevational view of an apparatus embodying this invention employing a plurality of axially spaced sets of cylinders wherein heat is extracted from a airstream produced by a fan mounted on the output shaft.

Referring now to FIG. 7, there is disclosed still another modification of this invention wherein the cooling of the cylinders 20 by the expanded gas is employed for air cooling purposes. An axial stack of apparatuses 1 identical to that heretofore described in FIG. 4 is employed but it should be understood that this modification would be effective with a single apparatus 1. In any event, an enclosure 100 is provided surrounding the one or more apparatuses 1. Housing 1 is provided with air inlet openings 101 in one end wall and air discharge openings 102 in the opposite end wall. Means are provided for circulating air through the housing 100 so that the circulated air flows past the cylinders 20 and is cooled thereby. Such circulation may be conveniently accomplished by a propeller type fan 95 which is mounted on the end of the output shaft 5. Propeller fan 95 is effective to draw air into the housing 100 through inlet openings 101, causing the air to flow past the chilled cylinders 20 and to discharge the chilled air through the discharge openings 102 into a suitable duct 103 leading to a room or chamber to be cooled.

The supply of high pressure air or gas for actuating the cylinders 20 and low pressure air or gas for controlling the internal pressure in the fluid pressure chambers 11 of each of the apparatus' 1 is simplified in FIG. 7. Thus, a main conduit 110 connected to a suitable source of pressurized gas supplies each of the inlet valves 40 of the various apparatuses 1 through conduits 111, 112 and 113. Instead of using an individual pressure regulating valve 15 on each of the apparatuses 1, each pressure regulator valve 15 is replaced with a nipple 15' and all of the nipples 15' are interconnected to a single conduit 115 which leads to a regulated low pressure gas source. Thus, a single pressure regulator will concurrently control the fluid pressure in each of the internal fluid pressure chambers 11 of the apparatuses 1.

From the foregoing description, it should be readily apparent to those skilled in the art that apparatus embodying this invention provides an inexpensive yet highly efficient method and apparatus for extracting heat and mechanical energy from a pressured gas. Insofar as the engine characteristics of the device are concerned, it develops a substantial torque at low speeds. It may be conveniently modified to function as a variable cylinder displacement engine in response to manual operation, or automatic operation as function of the load. When operating at less than its full cylinder capacity, the efficiency of the device is not reduced because the pistons in the non-energized cylinders do not reciprocate but merely lie in a steady state position in the cylinders until the internal pressure chambers associated with such cylinders is again energized. When utilized as a heat extraction device, the resulting cooled gas can be employed either in an open or conventional closed cycle air cooling or air conditioning system. Finally, by creating a stream of warm air past the apparatus while it is functioning as an expander, cooling of the airstream may be accomplished by warming the cylinders which have been exposed to the cool expanded gases.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

I claim:

1. Apparatus for extracting heat and mechanical energy from a pressured gas comprising: a rotatable output member; a linear fluid pressure actuator; means for fixedly mounting said actuator with its linear axis disposed in generally tangential relation relative to the rotation axis of said rotatable member; a one way clutch mounted on said rotatable output member; a lineary moveable output element cooperable with said fluid pressure actuator and movable between two extreme positions; means operatively connecting said output element to said one way clutch, whereby linear movement of said output element from one extreme position relative to said fluid pressure actuator produces rotation of said output member in one direction and linear movement of said output element toward said one extreme position produces no effect on said rotatable output member; valve means for introducing a pressured gas into said fluid pressure actuator as said output element approaches said one extreme position; thereby driving said output element toward said other extreme position; means for exhausting said pressured gas to ambient pressure when said output element approaches said other extreme position; and means for maintaining an above ambient pressure in the end of said actuator adjacent said other extreme position of said output element, thereby driving said output element away from said other extreme position.

2. The apparatus of claim 1 further comprising an air mover driven by said output shaft to produce an airstream past said actuator to warm said actuator by cooling the airstream.

3. Apparatus for extracting heat and mechanical energy from a pressured gas comprising: a rotatable output shaft; a fluid pressure cylinder having a closed end and an open end; means for fixedly mounting said cylinder with its linear axis disposed in generally tangential relation to the rotation axis of said output shaft; a piston cooperable with said cylinder; a one way clutch mounted on said shaft; connecting rod means extending through said open end of said cylinder for pivotally interconnecting said piston and said one way clutch, whereby linear movement of said piston away from the closed cylinder end produces rotation of said output shaft in one direction, and reverse movement of said piston has no effect on said output shaft; valve means for introducing a pressured gas into said closed end of said cylinder as said piston approaches said closed end, thereby driving said piston toward said open cylinder end; means for exhausting the expanded and cooled gas from said cylinder as said piston approaches said open cylinder end; and means for maintaining a fluid pressure in said open cylinder end sufficient to return said piston to said closed end of said cylinder independent of the rotation of said output shaft.

4. The apparatus defined in claim 3 further comprising resilient means for arresting movement of said piston toward said open end of said cylinder.

5. The apparatus of claim 3 wherein said means for fixedly mounting said cylinder comprises a fixedly mounted hollow housing defining a fluid pressure chamber; and said cylinder having its open end mounted in said housing and communicating with said fluid pressure chamber and its closed end projecting out of said hollow housing.

6. Apparatus for extracting heat and mechanical energy from a pressured gas comprising: a rotatable output shaft; a plurality of fluid pressure cylinders, each having a closed end and an open end; means for fixedly mounting said cylinders with their linear axes respectively disposed in generally tangential relation to the rotational axis of said output shaft; a piston cooperable with each said cylinder; a one way clutch mounted on said shaft; connecting rod means respectively extending through said open ends of said cylinders for pivotally interconnecting said pistons and said one way clutch, whereby linear movement of said pistons away from the closed cylinder ends produces rotation of said output shaft in one direction, and reverse movement of said pistons has no effect on said output shaft; valve means for introducing a pressured gas into the closed ends of said cylinders as said pistons respectively approach said closed ends, thereby driving said pistons toward said open cylinder ends; means for exhausting the expanded and cooled gas from said cylinders as said pistons respectively approach said closed ends, and means for maintaining a fluid pressure in said open cylinder ends sufficient to return said pistons respectively to said closed ends of said cylinders.

7. The apparatus defined in claim 6 wherein the means for fixedly mounting said cylinders comprises a hollow housing defining a sealed internal chamber with which said open ends of said cylinders respectively communicate; and said means for maintaining a fluid pressure in said open cylinder ends comprises means for maintaining a fluid pressure in said chamber.

8. The apparatus defined in claim 7 wherein a quantity of lubricating fluid is disposed in said sealed inner chamber to lubricate said pistons and said one way clutch.

9. The apparatus of claim 6 further comprising an air mover driven by said output shaft to produce an airstream past said actuator to warm said actuator by cooling the airstream.

10. The apparatus of claim 6 wherein said means for fixedly mounting said cylinders comprise a fixedly mounted hollow housing defining a fluid pressure chamber; each said cylinder having its open end mounted in said housing and communicating with said fluid pressure chamber and its closed end projecting out of said hollow housing.

11. Apparatus for extracting heat and mechanical energy from a pressured gas comprising a plurality of fluid pressure engines respectively mounted in axially spaced relationship on a rotatable output shaft; each engine comprising: a plurality of fluid pressure cylinders, each having a closed end and an open end, means for fixedly mounting said cylinders with their linear axes respectively disposed in generally tangential relation to the rotational axis of said output shaft, a piston cooperable with each said cylinder, a one way clutch mounted on said shaft, connecting rod means respectively extending through said open ends of said cylinders for pivotally interconnecting said pistons and said one way clutch, whereby linear movement of said pistons away from the closed cylinder ends produces rotation of said output shaft in one direction, and reverse movement of said pistons has no effect on said output shaft, valve means for introducing a pressured gas into the closed end of said cylinders as said pistons respectively approach said closed ends, thereby driving said pistons toward said open cylinder ends, means for exhausting the expanded and cooled gas from said cylinders as said pistons approach said open cylinder ends; and means for selectively supplying a fluid pressure to the open ends of the cylinders of selected engines, whereby any selected number of said fluid pressure engines may be rendered operative.

12. Apparatus for extracting heat and mechanical energy from a pressured gas comprising a plurality of fluid pressure engines respectively mounted in axially spaced relationship on a rotatable output shaft; each engine comprising: a plurality of fluid pressure cylinders, each having a closed end and an open end, means for fixedly mounting said cylinders with their linear axes respectively disposed in generally tangential relation to the rotational axis of said output shaft, a piston cooperable with each said cylinder, a one way clutch mounted on said shaft, connecting rod means respectively extending though said open ends of said cylinder for pivotally interconnecting said pistons and said one way clutch, whereby linear movement of said pistons away from the closed cylinder ends produces rotation of said output shaft in open direction, and reverse movement of said pistons has no effect on said output shaft, valve means for introducing a pressured gas into the closed end of said cylinders as said pistons respectively approach said closed ends, thereby driving said pistons toward said open cylinder ends, means for exhausting the expanded and cooled gas from said cylinders as said pistons approach said open cylinder and; and means for supplying a pressured fluid to said open cylinder ends of each engine in timed sequence, thereby sequentially returning said pistons of one of said fluid pressure engines to said closed ends of the respective cylinders in timed relationship to the return of the said pistons of another of said fluid pressure engines to said closed ends of the respective cylinders.

13. The method of extracting heat and mechanical energy from a pressured gas comprising the steps of:

(1) mounting a power output shaft for rotation about its axis;

(2) securing a one way clutch to said output shaft, said clutch having an oscillatable input member producing rotation of the output shaft in only one direction of oscillation;

(3) fixedly positioning a fluid pressure actuator having a linearly reciprocable output element adjacent said one way clutch;

(4) operatively interconnecting said output element of said fluid pressure actuator to said input member of said one way clutch;

(5) applying a pressured gas to said fluid pressure actuator when said output element is in one extreme position to shift said output member to its other extreme position to drive said oscillatable input member of said clutch in said one direction to rotate said output shaft;

(6) exhausting the expanded and cooled gas from the actuator; and (7) maintaining a fluid pressure in said actuator to return said output element to said one extreme position without affecting the rotation of said output shaft and independent of the rate of rotation of said output shaft.

14. The method of claim 13 wherein the pressured gas comprises air and further comprising the step of exhausting the expanded and cooled air from the fluid pressure actuator into a chamber to be cooled.

15. The method of claim 13 further comprising the steps of producing an airstream past said fluid pressure actuator to warm the actuator and cool the airstream.

16. The method of claim 15 further comprising the step of driving a fan by the output shaft to produce said airstream.

17. The method of extracting heat and mechanical energy from a pressured gas comprising the steps of:

(1) mounting a power output shaft for rotation about its axis;

(2) securing a one way clutch to said output shaft, said clutch having an oscillatable input member producing rotation of the output shaft in only one direction of oscillation;

(3) fixedly positioning a plurality of fluid pressure actuators in peripherally spaced relationship around said power output shaft; each actuator having a linearly reciprocable output element adjacent said one way clutch;

(4) operatively interconnecting said output elements of said fluid pressure actuators to said input member of said one way clutch;

(5) applying a pressured gas to each said fluid pressure actuator when the respective said output element is in one extreme position to shift said output member to its other extreme position to drive said oscillatable input member of said clutch in said one direction to rotate said output shaft;

(6) exhausting the expanded and cooled gas from the actuator; and, (7) maintaining fluid pressure in said actuators sufficient to return said output elements to said one extreme position without affecting the rotation of said output shaft and independent of the rate of rotation of said output shaft.

18. The method defined in claim 17 wherein said fluid pressure actuator comprises an open end cylinder disposed with its axis substanitally tengential relative to the axis of rotation of said output shaft and said output element comprises a piston reciprocal in said cylinder; said pressured gas being introduced into the closed end of said cylinder when said piston approaches said closed end; and said expanded and cooled gas being exhausted as said piston approaches the open end of said cylinder.

19. The method of claim 13 further comprising the step of directing the expanded and cooled gas into a heat exchanger to extract heat from another fluid passing through the heat exchanger.

20. The method of claim 19 further comprising the steps of compressing and further heating the reheated gas to return same to its original pressured state in a closed cycle.

21. The method of claim 17 wherein the pressured gas comprises air and further comprising the step of exhausting the expanded and cooled air from the fluid pressure actuator into a chamber to be cooled.

22. The method of claim 18 further comprising the step of directing the expanded and cooled gas into a heat exchanger to extract heat from another fluid passing through the heat exchanger.

23. The method of claim 22 further comprising the step of compressing and further heating the reheated gas to return same to its original pressured state in a closed cycle.

24. The method of extracting heat and energy from a pressured gas comprising the steps of:

(1) fixedly mounting a fluid pressure cylinder having a closed end and an open end with the cylinder axis disposed substantially tangentially relative to the axis of rotation of a power output shaft;

(2) mounting a piston in said cylinder for linear reciprocating movements along the cylinder axis;

(3) mounting a one way clutch on said output shaft and pivotally connecting said piston to said one way clutch by a connecting rod extending through said open end of said cylinder, whereby linear movement of said piston away from said closed cylinder end drives said output shaft in one direction, and reverse linear movement of said piston has no effect on said output shaft;

(4) introducing a pressured gas into the closed end of said cylinder when said piston approaches said closed end, thereby driving said output shaft in said one direction by expansion and cooling of the pressured gas;

(5) exhausting the cooled and expanded gas from said cylinder as said piston moves toward said open end of the cylinder; and, (6) maintaining a pressured gas in the open end of said cylinder, thereby returning said piston to the closed end of the cylinder independent of the rotation of said output shaft.

25. The method of claim 24 further comprising the step of fixedly mounting a plurality of open end cylinders and cooperating pistons in peripherally spaced relation around the output shaft; connecting all said pistons to said one way clutch as per step (3) of claim 24, and performing steps (4) through (6) of claim 24 for all said pistons and cylinders.

26. The method of claim 24 further comprising the steps of fixedly mounting an additional open end cylinder and cooperating piston with its linear axis generally tangetially disposed relative to the axis of said output shaft and axially spaced relative to the linear axis of the first mentioned cylinder; mounting a second one way clutch on said output shaft in axial alignment with said additional cylinder; connecting the additional piston to said second one way clutch to drive the output shaft in said one direction of rotation; and performing step (6) of claim 19 on said additional piston and cylinder but at times intermediate the performance of the corresponding operations on the first mentioned piston and cylinder.

27. The method of claim 24 further comprising the step of directing the expanded and cooled gas into a heat exchanger to extract heat from another fluid passing through the heat exchanger.

28. The method of claim 27 further comprising the step of compressing and further heating the reheated gas to return same to its original pressured state in a closed cycle.

29. The method of claim 24 further comprising the steps of fixedly mounting an additional open end cylinder and cooperating piston with its linear axis generally tangentially disposed relative to the axis of said output shaft and axially spaced along said output shaft relative to the linear axis of the first mentioned cylinder; mounting a second one way clutch on said output shaft in axial alignment with said additional cylinder; connecting the additional piston to a second one way clutch to drive the output shaft in said one direction of rotation; and selectively performing step (6) of claim 24 on both or one of said cylinders, thereby selecting one of two effective displacement volumes of the apparatus.

30. The method of claim 24 wherein the pressured gas comprises air and further comprising the step of exhausting the expanded and cooled air from the fluid pressure actuator into a chamber to be cooled.

31. The method of claim 24 further comprising the steps of producing an airstream past said fluid pressure cylinder to warm the cylinder and cool the airstream.

32. The method of claim 31 further comprising the step of driving a fan by the output shaft to produce said airstream.

33. A variable displacement engine operable by a pressured gas comprising a rotatable output shaft; a unidirectional clutch having an inner element secured to said output shaft and an oscillatable outer element producing rotation of said output shaft in only one rotary direction; a plurality of fluid pressure actuators fixedly mounted in peripherally spaced relation around the axis of said output shaft and adjacent to said unidirectional clutch; each said actuator having a linearly reciprocable output element; linkage means interconnecting each said output element to said outer element of said unidirectional clutch, whereby linear movement of each said output element in one direction from one extreme position produces rotation of said output shaft in said one rotary direction, and linear movement of each said output element in the opposite direction has no effect upon said output shaft; means for supplying pressured gas to said actuators when the corresponding output elements reach said one extreme position; and means for supplying a fluid pressure only to each selected actuator to return the corresponding output element to said one extreme position.

34. A variable displacement engine operable by a pressured gas comprising a rotatable output shaft; a unidirectional clutch having an inner element secured to said output shaft and an oscillatable outer element producing rotation of said output shaft in only one rotary direction; a plurality of fluid pressure actuators fixedly mounted in peripherally spaced relation around the axis of said output shaft and adjacent to said unidirectional clutch; each said actuator having a linearly reciprocable output element; linkage means interconnecting each said output element to said outer element of said unidirectional clutch, whereby linear movement of each said output element in one direction from one extreme position produces rotation of said output shaft in said one rotary direction, and linear movement in each said output element in the opposite direction has no effect upon said output shaft; means for supplying pressured gas to each of said acutators when the corresponding output element reaches said one extreme position; and means for supplying a fluid pressure to a selected number of actuators to return the corresponding output elements to said one extreme position, whereby the number of actuators operating at any time may be selectively varied.

35. A variable displacement engine operable by a pressured gas comprising a rotatable output shaft; a first unidirectional clutch having an inner element secured to said output shaft and an oscillatable outer element producing rotation of said output shaft in only one rotary direction; a first plurality of fluid pressure actuators fixedly mounted in peripherally spaced relation around the axis of said output shaft and adjacent to said first unidirectional clutch; a second unidirectional clutch having an inner element secured to said output shaft and an oscillatable outer element producing a rotation of said output shaft in only one rotary direction; said second unidirectional clutch being axially spaced relative to said first unidirectional clutch; a second plurality of fluid pressure actuators fixedly mounted in peripherally spaced relation around the axis of said output shaft and adjacent said second unidirection clutch; each said actuator having a linearly reciprocable output element, linkage means interconnecting each said output element of said first plurality of fluid pressure actuators to said outer elements of said first unidirectional clutch; linkage means interconnecting each said output element of said second set of actuators to said outer element of said second unidirectional clutch, whereby linear movement of each said output element in one direction from one extreme position produces rotation of said output element in one direction from one extreme position produces rotation of said output shaft in said one rotary direction and linear movement of each said output element in the opposite direction has no effect on said output shaft; means for supplying pressured gas to said actuators when the corresponding output element reaches said one extreme position; and means for selectively supplying a fluid pressure to all of said actuators to return the corresponding output elements to said one extreme position or to only said first plurality of actuators, thereby permitting selective utilization of all or half of said actuators to drive said rotary shaft.

* * * * *